United States Patent [19]

Garrood et al.

[11] Patent Number: 4,833,484

[45] Date of Patent: May 23, 1989

[54] EARTH TERMINAL FOR SATELLITE COMMUNICATION

[75] Inventors: David Garrood, Slough; Roger Crawshaw, High Wycombe; Ian Henderson; Frank A. Dutton, both of Chelmsford, all of England

[73] Assignee: The General Electric Company, p.l.c., London, United Kingdom

[21] Appl. No.: 664,820

[22] Filed: Oct. 25, 1984

[30] Foreign Application Priority Data

Feb. 9, 1984 [GB] United Kingdom ..... 8403445

[51] Int. Cl.[4] ..... H01Q 19/14

[52] U.S. Cl. ..... 343/781 CA; 343/713; 343/851; 343/915

[58] Field of Search ..... 343/758, 786, 781 CA, 343/840, 841, 705, 713, 851, 915

[56] References Cited

U.S. PATENT DOCUMENTS

| | | | |
|---|---|---|---|
| 2,703,842 | 3/1955 | Lewis | 343/840 |
| 2,717,312 | 9/1955 | Taylor | 343/841 |
| 3,026,517 | 3/1962 | Nameth et al. | 343/758 |
| 3,646,564 | 2/1972 | Drislane | 343/766 |
| 3,803,614 | 4/1974 | Reid | 343/705 |
| 3,922,682 | 11/1975 | Hyde | 343/840 |
| 3,995,275 | 11/1976 | Betsudan et al. | 343/781 CA |
| 4,263,599 | 4/1981 | Bielli et al. | 343/786 |
| 4,309,708 | 1/1982 | Sayovitz | 343/713 |
| 4,314,253 | 2/1982 | Sayovitz | 343/915 |

FOREIGN PATENT DOCUMENTS

| | | |
|---|---|---|
| 1513452 | 6/1978 | United Kingdom . |
| 2098806 | 11/1982 | United Kingdom . |
| 2115229 | 9/1983 | United Kingdom . |
| 2139596 | 11/1984 | United Kingdom . |

OTHER PUBLICATIONS

B. H. Burdine et al, "A Low Sidelobe Earth Station Antenna for the 4/6 GHz Band", *Microwave Journal*, vol. 23, No. 11, Nov. 1980, pp. 53–58.

H. P. Coleman et al, "Low Sidelobe Antennas for Millimeter Wave Communications Systems", AP-S International Symposium, IEEE, 1975, pp. 240–243.

Kenichi Kagoshima et al, "A 30/20 GHz Band High--Efficiency Small Earth-Station Antenna with Elliptical Beam", ICC'81 International Conference on Communications, vol. 2, Jun. 14–18th, 1981, pp. 26.41.1–26.4.5.

G. P. Heckert, "Readily Transportable Earth Stations for Satellite Communications", ICC'80 International Conference on Communications, vol. 3, Jun. 8th–12th, 1980, pp. 36.4.3–36.4.4.

R. B. Dybdal et al, "Horn Antenna Sidelobe Reduction Using Absorber Tunnels", IEEE AP-S International Symposium, 1977, pp. 324–327.

*Primary Examiner*—William L. Sikes
*Assistant Examiner*—Robert E. Wise
*Attorney, Agent, or Firm*—Spencer & Frank

[57] ABSTRACT

An earth terminal for a satellite communication system incorporates an oval or eliptical shaped antenna 1 whose horizontal dimension $d_1$ is greater than it's vertical dimension $d_2$. The relatively small dimension $d_2$ allows the antenna to be transported by road while at the same time giving a beam shape which is broader in elevation than in azimuth. This special beam shape gives certain advantages which are described in the specification.

17 Claims, 1 Drawing Sheet

EARTH TERMINAL FOR SATELLITE COMMUNICATION

BACKGROUND OF THE INVENTION

This invention relates to an earth terminal for satellite communication systems.

The invention arose in the design of a road transportable terminal. A previous design had incorporated a circular antenna reflector of three meters diameter which, whilst large for the purposes of road transport, presented no insurmountable problems in this respect. However, with the increasing number of communication satellites it has now become necessary to use more highly directional antennas to prevent interference between different satellite communication systems.

In order to meet the requirement for improved directionality, a four meter diameter reflector was initially considered necessary but it soon became apparent that this could not be transported by road because of height limitations imposed by bridges and other overhead obstructions. Similar difficulties arise with air transport where a height limitation is imposed by the shape of the aircraft fuselage.

SUMMARY OF THE INVENTION

This invention provides an earth terminal for a satellite communication system comprising an antenna reflector which is broader in a first dimension than in a second orthogonal dimension.

If the first dimension is arranged horizontally it can be increased to four meters or more without presenting the aforementioned transportation difficulties and it was for this reason that the idea of having one diemnsion greater than the other was originally proposed. Surprisingly it was found that the limitation on the second dimension does not present a problem. This is because many communication satellites are arranged in geostationary orbits around the equator and will thus be seen to lie in a continuous line when viewed from any part of the earth's surface, this line extending for practical purposes in the East-West or azimuth direction. Lack of directionality in a North-South direction perpendicular to this line (i.e., in elevation) and due to the relatively small "second" dimension of the antenna reflector therefore does not cause interference with neighbouring satellites.

Because of inaccuracies in positioning geostationary satellites they do not appear, to an observer on the ground, to be truly stationary but rather move about in a region extending both in azimuth and elevation. For this reason an earth terminal, in accordance with the invention, preferably includes means for tracking the satellite in azimuth. This is desirable because the highly directional characteristics of the antenna in azimuth means that the beamwidth does not simultaneously illuminate the whole of the area of movement of the satellite. The tracking facility also greatly facilitates setting up of the system when it arrives at its destination since it eliminates the need to set the boresight of the antenna accurately to the known centre of the azimuthal movement of the satellite. This has previously been a problem in transportable satellite communication systems because of the difficulty in obtaining an accurate azimuth reference. It would also be a problem in domestic, community and like terminals designed just to receive and not to transmit where speed and ease of installation is important for cost reasons. The invention, whilst particularly applicable to transportable systems can thus be usefully applied to some fixed systems. Also, it is apparent from the foregoing that, whilst the invention is particularly applicable to the type of antenna which incorporates a reflector dish, the invention would also be applicable to phased array antennas. Accordingly, the invention also provides an earth terminal for a satellite communication system comprising an antenna system designed and arranged so that the main lobe of it's gain characteristics is broader in the North-South direction perpendicular to the orbit of the satellite than in the East-West direction of the orbit of the satellite.

The earth terminal of this invention preferably does not include means for tracking the satellite in elevation. The cost of including an elevation tracking system is not considered necessary firstly because the relatively short "second" dimension of the reflector can give a beamwidth in elevation sufficiently wide to embrace the whole area of movement of the satellite; and secondly because accurate inclination measuring devices are available. This means that the previously mentioned difficulty of correctly setting the azimuth of the antenna does not apply to setting the elevation.

In order to improve further the ease with which the antenna can be transported, the sub-reflector and preferably also the feed are mounted on a pivotted supporting frame which can be folded away to a position close to the main reflector. This makes a compact arrangement either for transportation by road if the whole assembly is formed as part of a road trailer or vehicle, or for storage in a standard container.

Thus, according to another aspect of the invention there is provided a transportable antenna comprising a supporting structure, a main antenna reflector pivotted relative to the supporting structure about orthogonal axes, a sub-reflector, a feed, and a supporting frame carrying the sub-reflector and pivotted relative to the reflector so as to enable the sub-reflector to be pivotted from an operational position where it is spaced from the main relector to a position for transportation where it is located relatively close to the main reflector.

To avoid inteference with other communication systems employing, for example, an adjacent satellite in the geostationary orbit it may be required that the earth terminal transmit a very low amount of radiation in directions other than the specified main lobe of the antenna. Another aspect of the invention aims to meet this requirement and provides a Cassegrain antenna comprising a feed, a sub-reflector arranged to be illuminated by the feed and a main reflector arranged to receive the radiation after reflection from the sub-reflector, characterised by a shielding device defining an annular region of shielding between the feed and the sub-reflector so as to obstruct radiation from the feed which would otherwise miss the sub-reflector.

By employing this technique a substantial reduction in "spillover" i.e., radiation missing the sub-reflector, can be achieved thereby reducing the amount of radiation emitted in directions other than that required. The shield also preferably has the effect of reducing the intensity of radiation in the edge regions of the main reflector thus reducing the amount of radiation which misses the latter.

BRIEF DESCRIPTION OF THE DRAWINGS

One way in which the invention may be performed will now be described with reference to the accompanying illustrations in which.

DETAILED DESCRIPTION OF THE PREFERRED EMBODIMENT

Figure 1:
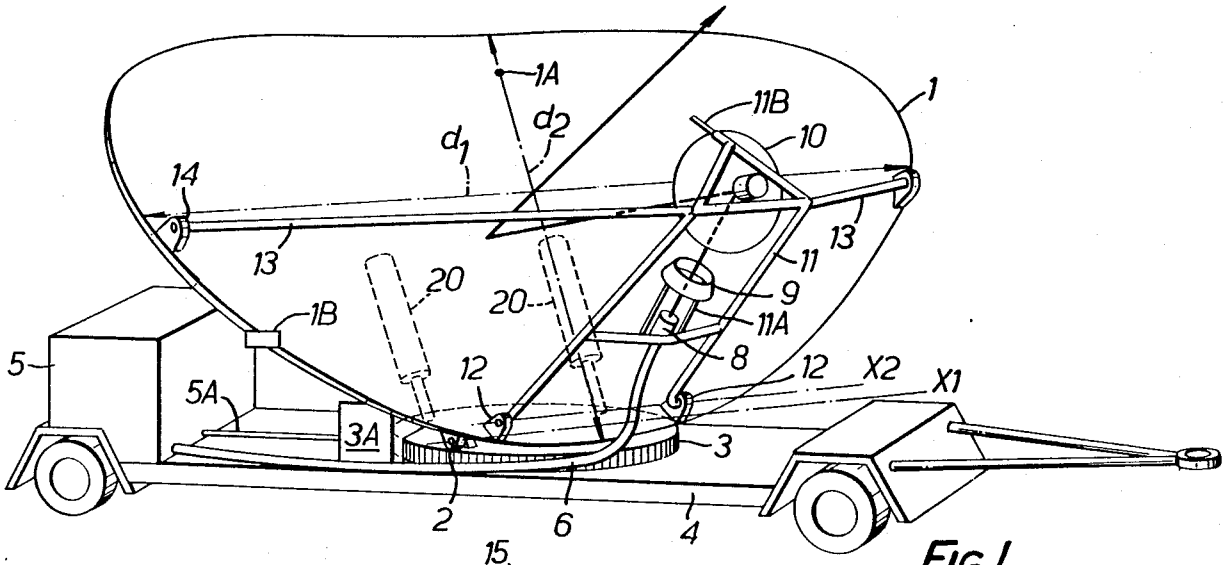
FIG. 1 is a schematic perspective view of a road transportable antenna according to the invention and forming part of a satellite communication system for any form of satellite communication.

Referring to FIG. 1 of the drawings, there is illustrated a road-trailer-mounted offset Cassegrain antenna with an eliptical main reflector 1 having a first maximum dimension $d_1$ in the horizontal plane and a second minimum dimension $d_2$ in an orthogonal plane. The design of Cassegrain antenna systems is well known, being described, for example, by Brain in a paper published in the MARCONI REVIEW 1978, and by Burdine and Wilkinson in THE MICROWAVE JOURNAL, Vol. 23, No. 11, November 1980. As is known, a Cassegrain antenna has a main reflector which is concave and a sub-reflector which may be convex or concave. The reflector 1 has lugs such as shown at 2 by which it is pivotted about a horizontal axis X1 on a turntable 3 which can be rotated about an orthogonal vertical axis on a frame 4 which forms part of a road trailer. The trailer carries a television tranceiver 5 from which energy to be transmitted is fed along a flexible waveguide 6 to a feed horn 8. From the horn 8, the energy is directed through a shielding device 9 onto an offset concave sub-reflector 10 and then to the main reflector 1. The feed horn 8, shielding device 9 and sub-reflector 10 are mounted on a framework 11 which is pivotable about a horizontal axis X2, on lugs 12 fixed to the reflector 1. The framework 11 is held at the illustrated operational position by removable stays 13, each secured at one end to framework 11 and at the other end to a respective lug 14 also fixed to the reflector 1. The feed horn 8, shielding device 9 and sub-reflector 10 are designed so as to illuminate substantially the whole of the main reflector 1. The larger diameter $d_1$ results in a narrower beamwidth in azimuth than is achieved in elevation by the smaller diameter $d_2$. The sub-reflector 10 is designed to spread the energy ariving from the horn 8 across the axes $d_1$ and $d_2$ of the reflector 1 in such a way that the energy is tapered from the centre of the reflector to the edges to a greater extent in the dimension $d_1$ than in the dimension $d_2$. It is desirable to accomplish this because the greater taper in direction $d_1$ will result in a relatively lower level of sidelobes, while the lesser taper in direction $d_2$, whilst resulting in higher sidelobes, assists in maintaining the highest possible directionality from the complete aperture.

The purpose of the shielding device 9, supported between the horn 8 and sub-reflector 10 on struts 11A forming part of the framework 11, is to act as an obstruction to radiation from the horn which would otherwise miss the sub-reflector 10. It also reduces the radiation intensity at the edges of the sub-reflector 10 and therefore in the region of the edges of the main reflector 1, thus reducing the amount of radiation from the sub-reflector which misses the main reflector. The radiation which misses the two reflectors is called "spill-over" and it is desirable to reduce this as much as possible to minimise interference e.g., with other satellite communication systems. The shielding device 9 is, as shown in FIG. 1 formed by a frusto-conical metal surface tapering towards the sub-reflector 10. This is preferable to an annular surface since it enables a shielding effect to be obtained over a considerable angle without obstructing radiation passing from the sub-reflector 10 to the main reflector 1.

Figure 2:
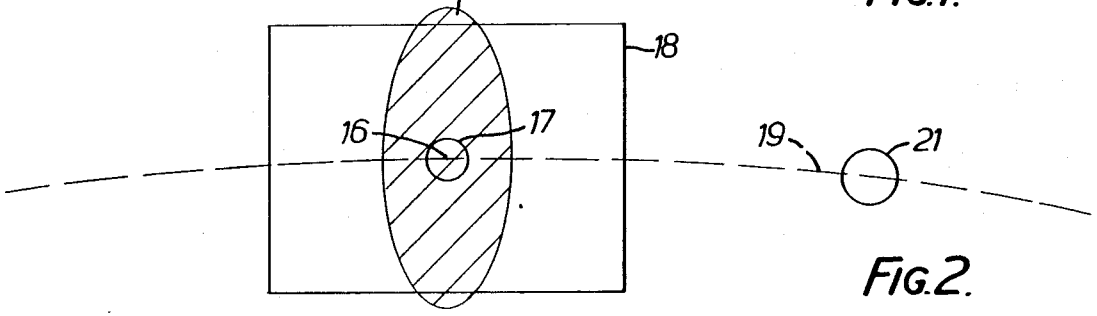
FIG. 2 illustrates schematically the relationship of the beam shape of the antenna shown in FIG. 1 with the locus of movement of the satellite.

The main lobe of the transmitted beam is shown schematically by the shaded area 15 on FIG. 2. It's boresight 16 is shown aligned with a satellite 17 which moves within a roughly square region 18 centred on a geostationary orbit 19 of the satellite 17.

Before deployment, the main reflector 1 lies substantially horizontally on the frame 4, the stays 13 are stowed away, and the framework 11 is folded so as to lie against the main reflector 1. An extension 11B of the framework 11 extends through a hole 1A in the reflector 1 and is secured thereto by a catch mechanism (not shown) behind the reflector 1.

When the illustrated transmitter is to be deployed, the reflector 1 is tilted in elevation on its lugs 2 by manually operated jacks shown schematically at 20 and is rotated in azimuth using the turntable 3 and a servo mechanism 3A which engages teeth on the edge of the turntable. An accurate inclination sensing instrument 1B is used to enable the boresight 16 to be set at the elevation of the orbit 19 as illustrated. The azimuth is then set roughly to the direction of the satellite using a relatively inaccurate compass. Fine adjustment is then effected by an operator until the satellite has been acquired. Following this, the satellite is automatically tracked in azimuth during movements from one side to another of the square 18. The tracking is effected by automatic rotation of turntable 3 by the servo mechanism 3A under the control of the tranceiver 5 via line 5A.

Because of the highly directional nature of the transmitted beam in azimuth coupled with the lower sidelobes in this plane, interference with other communication systems using other satellites such as that shown at 21 on FIG. 2 is avoided. Deployment of the system is facilitated because of the provision of the azimuth tracking system which provides the necessary mechanical means for the operator to effect the fine adjustment referred to previously, and ensures that the beam is correctly aligned in azimuth with the satellite. Finally of course the shape of the antenna enables it, and it's transporter, to travel under most road bridges and overhead obstacles or, in a slightly modified version to be carried by air.

There may be positions on the surface of the earth where the position of the satellite with which it is desired to communicate is such that the geostationary oribt appears inclined to the horizontal. In such positions the antenna can take advantage of the features already described if the axis $d_1$ is inclined so that it lies effectively tangential to the position of the satellite in the geostationary arc as viewed from the antenna. Such an inclined mounting arrangement can be readily achieved on a permanent stationary installation.

We claim:

1. A transportable off-set dual reflector antenna comprising a supporting structure, a main antenna reflector, means for mounting said main reflector on said supporting structure so that said main reflector is pivotable relative to the supporting structure about orthogonal axes, a subreflector, a feed, a supporting frame carrying the sub-reflector, and means for mounting said subreflector for pivotable movement relative to the main reflector such that the sub-reflector can be pivotted from an operational position where it is spaced from the main reflector to a position for transportation where it is located relatively close to the main reflector.

2. An antenna according to claim 1 in which the feed is also carried on the frame.

3. An antenna according to claim 1 including a shielding means mounted on the frame between the feed and the sub-reflector for obstructing stray radiation from the feed which would otherwise miss the sub-reflector.

4. An antenna as defined in claim 1 wherein said main reflector is broader in a first horizontal direction than in a second direction orthogonal to said horizontal direction.

5. In an off-set dual reflector antenna comprising a feed, a sub-reflector arranged to be illuminated by the feed and a main reflector arranged to receive the radiation after reflection from the sub-reflector; the improvement wherein a shielding means defining an annular region of shielding is disposed between the feed and the sub-reflector, for obstructing radiation from the feed which would otherwise miss the sub-reflector.

6. A Cassegrain antenna comprising a feed, sub-reflector arranged to be illuminated by the feed and a main reflector arranged to receive the radiation after reflection from the sub-reflector, characterised by a shielding device defining an annular region of shielding between the feed and the sub-reflector so as to obstruct radiation from the feed which would otherwise miss the sub-reflector.

7. An antenna according to claim 6 in which the shielding mean is supported by struts on a frame carrying the feed and the sub-reflector.

8. An antenna according to claim 6 in which the shielding mean comprises a frusto-conical shielding surface tapered towards the sub-reflector and whose axis is aligned with the optical axis between the feed and the sub-reflector.

9. In an earth terminal for a satellite communication system employing one of a number of closely spaced satellites in a geostationary orbit, with said earth terminal comprising an antenna having a reflector which defines a reflecting surface which is broader in a first dimension aligned with the said orbit than in a second dimension which is orthogonal to the orbit, and an antenna feed means for feeding radiation to or receive radiation from the said reflecting surface and arranged relative to said reflecting surface so as to generate an antenna gain pattern whose main lobe is narrower in the direction of the geostationary orbit than in the orthogonal direction; the improvement wherein: said antenna is an off-set dual reflector antenna and said feed means includes a a feed horn and a sub-reflector; and said antenna further includes shielding means, disposed between said feed horn and said sub-reflector, and defining an annular shielding region, for obstructing radiation from said feed horn which would normally miss said reflector.

10. An earth terminal according to claim 9 including: a road trailer; and means for mounting said antenna on said trailer for transporting said antenna.

11. An earth terminal according to claim 9 wherein said reflector and said feed means generate, in use, an antenna gain pattern whose main lobe embraces the whole of the range of movements of the satellite in said direction orthogonal to said orbit direction but only part of the range of movements of the satellite in said orbit direction; and wherein said earth terminal further includes means for tracking the satellite in the latter direction but not in the former direction.

12. An earth terminal as defined in claim 9 further comprising tracking means, including means for rotating said reflector and said feed means about a substantially vertical axis, for tracking a satellite in azimuth along said orbit.

13. An earth terminal as defined in claim 9 wherein said shielding means comprises a frusto-conical shielding surface which narrowingly tapers in a direction toward said sub-reflector and whose longitudinal axis is aligned with the optical axis between said feed horn and said sub-reflector.

14. In an earth terminal for a satellite communicatiin system employing one of a number of closely spaced satellites in a geostationary orbit, with said earth terminal comprising an antenna having a reflector which defines a reflecting surface which is broader in a first dimension aligned with the said orbit than in a second dimension which is orthogonal to the orbit, and an antenna feed means for feeding radiation to or receive radiation from the said reflecting surface and arranged relative to said reflecting surface so as to generate an antenna gain pattern whose main lobe is narrower in the direction of the geostationary orbit than in the orthogonal direction; the improvement wherein said antenna is an off-set dual reflector antenna with said reflector being the main-reflector, and said feed means includes a feed horn and a sub-reflector mounted on a supporting frame, and further comprising: a transportable supporting structure for said antenna; means for pivotably mounting said main reflector on said supporting structure for movement relative to said supporting structure about orthogonal axes; and means for mounting said supporting frame on said main reflector to enable said sub-reflector to be pivoted from an operational position where it is spaced from said main reflector to a position for transportation where it is located relatively close to said main reflector.

15. An earth terminal according to claim 14 further comprising shielding means, mounted on said frame between said feed horn and said sub-reflector, for obstructing stray radiation from said feed horn which would otherwise miss said sub-reflector.

16. An earth terminal according to claim 15 in which said shielding means includes a frusto-conical surface tapering towards the sub-reflector.

17. An antenna as defined in claim 14 wherein said supporting structure is a road trailer.

* * * * *

UNITED STATES PATENT AND TRADEMARK OFFICE

CERTIFICATE OF CORRECTION

PATENT NO. : 4,833,484

DATED : May 23rd, 1989

INVENTOR(S) : David Garrood; Roger Crawshaw; Ian Henderson; Frank A. Dutton

It is certified that error appears in the above-identified patent and that said Letters Patent is hereby corrected as shown below:

In the heading of the patent under [21]: change "664,820" to --664,720--.

Signed and Sealed this

Twenty-first Day of August, 1990

*Attest:*

HARRY F. MANBECK, JR.

*Attesting Officer*

*Commissioner of Patents and Trademarks*